US007458111B2

(12) United States Patent
Sappenfield et al.

(10) Patent No.: US 7,458,111 B2
(45) Date of Patent: Dec. 2, 2008

(54) MAGNETICALLY COUPLED MODULAR SAUNA

(75) Inventors: Jasen Sappenfield, Overland Park, KS (US); Aaron M. Zack, Lenexa, KS (US)

(73) Assignee: Sunlight Saunas, Inc., Lenexa, KS (US)

( * ) Notice: Subject to any disclaimer, the term of this patent is extended or adjusted under 35 U.S.C. 154(b) by 236 days.

(21) Appl. No.: 11/162,246

(22) Filed: Sep. 2, 2005

(65) Prior Publication Data

US 2007/0050903 A1 Mar. 8, 2007

(51) Int. Cl.
*A61H 33/06* (2006.01)

(52) U.S. Cl. ..... 4/524

(58) Field of Classification Search ..... 4/524–526, 4/528, 533

See application file for complete search history.

(56) References Cited

U.S. PATENT DOCUMENTS 4,773,105 A * 9/1988 Toyoshima ..... 4/526
5,255,399 A * 10/1993 Park ..... 4/525
5,870,780 A * 2/1999 Prommer ..... 4/527
6,615,419 B1 * 9/2003 Chang ..... 4/524
6,888,105 B2 * 5/2005 Seibert et al. ..... 219/400

FOREIGN PATENT DOCUMENTS

JP 169028 * 6/2005

OTHER PUBLICATIONS

Sunlight Saunas User's Manual depicting prior art sauna and conventional interconnection of sauna walls (2005 publication that is substantially similar to manual distributed prior to Sep. 2, 2004).

* cited by examiner

*Primary Examiner*—Huyen Le
(74) *Attorney, Agent, or Firm*—Shook, Hardy & Bacon L.L.P.

(57) ABSTRACT

Improved, aesthetically appealing enclosure assemblies, such as dry saunas (20), are provided which eliminate unsightly threaded fasteners and other external connection hardware, while also affording an easy method of construction. The saunas (20) include a base panel (22), upright panels (24) and a top panel (26) cooperatively defining the sauna enclosure (28). The interconnection between the upright panels (24) is achieved through the use of complemental, magnetic coupler bodies (70,72,92,94,108,110) which are sized and located for direct, face-to-face contact and consequent strong magnetic attraction. The saunas (20) are equipped with internal far infrared heaters (30,32) which are likewise magnetically mounted through the use of coupler bodies (96-100 and 152-156).

15 Claims, 9 Drawing Sheets

MAGNETICALLY COUPLED MODULAR SAUNA

BACKGROUND OF THE INVENTION

1. Field of the Invention

The present invention is broadly concerned with saunas and other enclosure assemblies preferably used for personal care. More particularly, the invention pertains to such enclosures having at least certain panels connected using structure including magnetic coupler bodies operable to interconnect the panels by means of magnetic attraction. In this fashion, the enclosures can be rapidly and easily constructed, and not exhibit threaded fasteners or other unsightly external connection hardware. Additionally, internal infrared heaters can be connected to the enclosure panels using magnetic coupler bodies.

2. Description of the Prior Art

Dry saunas are becoming increasingly popular as personal accessories in modern homes. These saunas are typically relatively small in size (housing from 1-6 individuals), and are designed to deliver on-demand healthful dry heat therapy. In order to lessen the cost of such saunas, some manufacturers provide kits which can be assembled on-site by a homeowner. Generally, these sauna kits make use of threaded fasteners, brackets, or other conventional connection hardware in order to interconnect the sauna components, and especially the upright side panels thereof.

While these constructions are accepted and of long standing, they are deficient in that the connection structure employed is visible, either from the exterior of the sauna or its interior, or both. This detracts from the appearance of the finished saunas which are made of high-quality wood such as cedar.

In order to increase the salability of homeowner-constructed saunas and other personal care enclosures, it is important that they be relatively simple to construct and install, and aesthetically pleasing. While some prior sauna kits using conventional connection hardware meet these goals to a limited extent, there remains a need in the art for improved personal enclosure designs which more adequately address consumer demand.

SUMMARY OF THE INVENTION

The present invention overcomes the problems outlined above and provides personal enclosures such as saunas which essentially eliminate the use of visible connection hardware, while also being simple to construct.

Broadly speaking, a first aspect of the present invention concerns an enclosure assembly comprising a base panel, a plurality of upright panels extending upwardly from the base panel, and a top panel positioned atop the upright panels. The panels cooperatively define a personal care enclosure sized to simultaneously house no more than about six persons. The enclosure assembly further includes connection structure between at least certain of the panels and including complemental magnetic coupler bodies operable to magnetically interconnect the certain panels. In preferred forms, the couplers are embedded in the ends of the upright panels and oriented for direct, face-to-face contact.

In another aspect of the present invention, a sauna comprises a base panel, a plurality of upright panels extending upwardly from the base panel, and a top panel surmounting the upright panels. The panels cooperatively define a sauna enclosure. The sauna also includes at least one sauna heater operable to heat the sauna enclosure. Yet further, the sauna includes connection structure between at least certain of the panels and including complemental magnetic coupler bodies operable to magnetically interconnect the certain panels.

Another aspect of the present invention concerns a sauna comprising a base panel, a plurality of upright panels extending upwardly from the base panel, and a top panel surmounting the upright panels. The panels cooperatively define a sauna enclosure. The sauna also includes a sauna heater operable to heat the sauna enclosure. Additionally, the sauna includes mounting structure securing the sauna heater to at least one of the panels. The mounting structure comprises a magnetic coupling structure magnetically mounting the sauna heater to the at least one of the panels.

Other aspects and advantages of the present invention will be apparent from the following detailed description of the preferred embodiments and the accompanying drawing figures.

BRIEF DESCRIPTION OF THE DRAWING FIGURES

A preferred embodiment of the present invention is described in detail below with reference to the attached drawing Figures, wherein.

Figure 1:
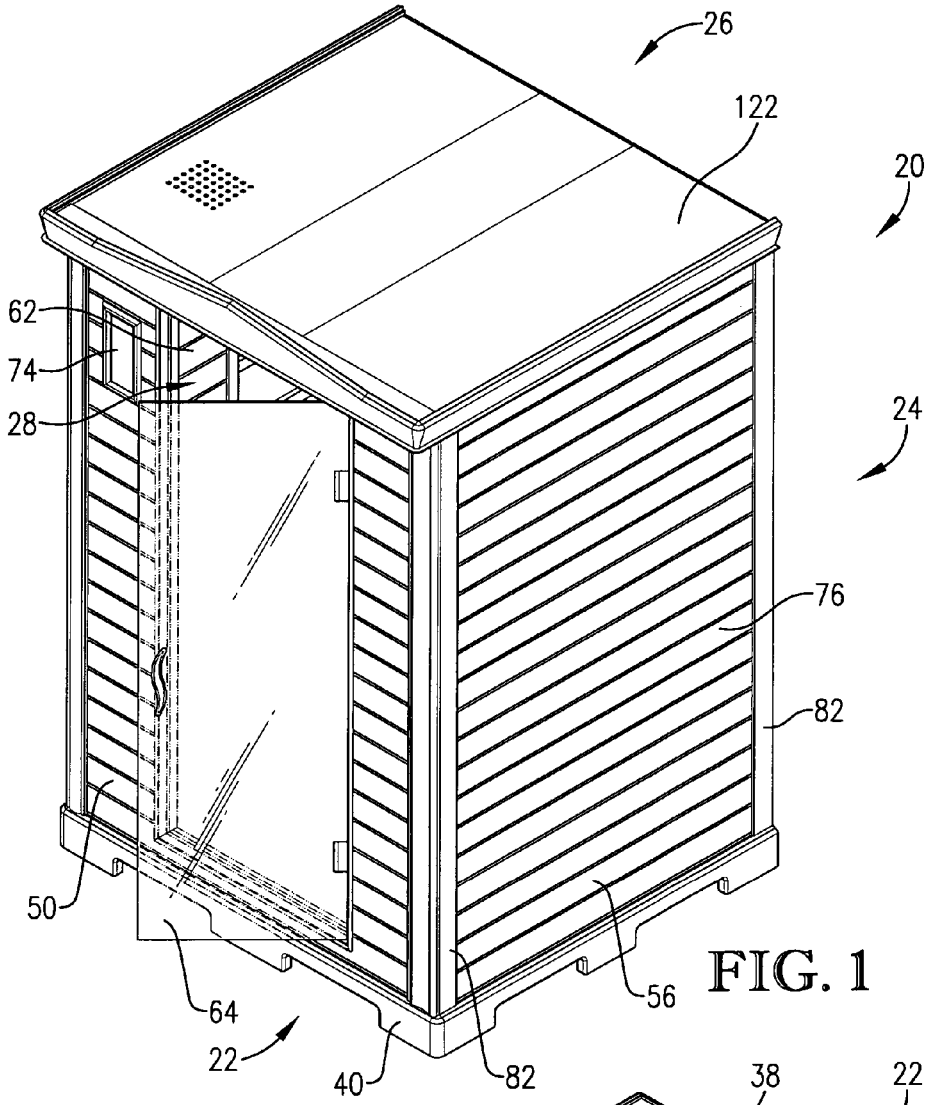
FIG. 1 is a perspective view of an assembled modular sauna in accordance with a preferred embodiment of the present invention.
Figure 2:
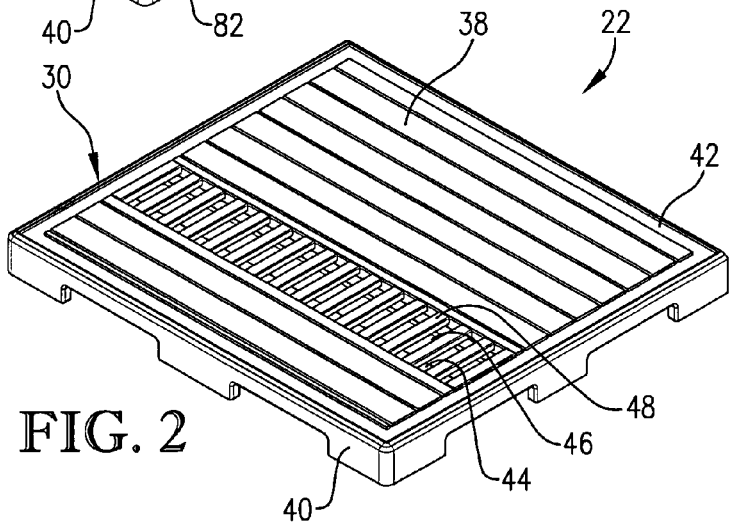
FIG. 2 is a perspective view of the base panel of the sauna.
Figure 3:
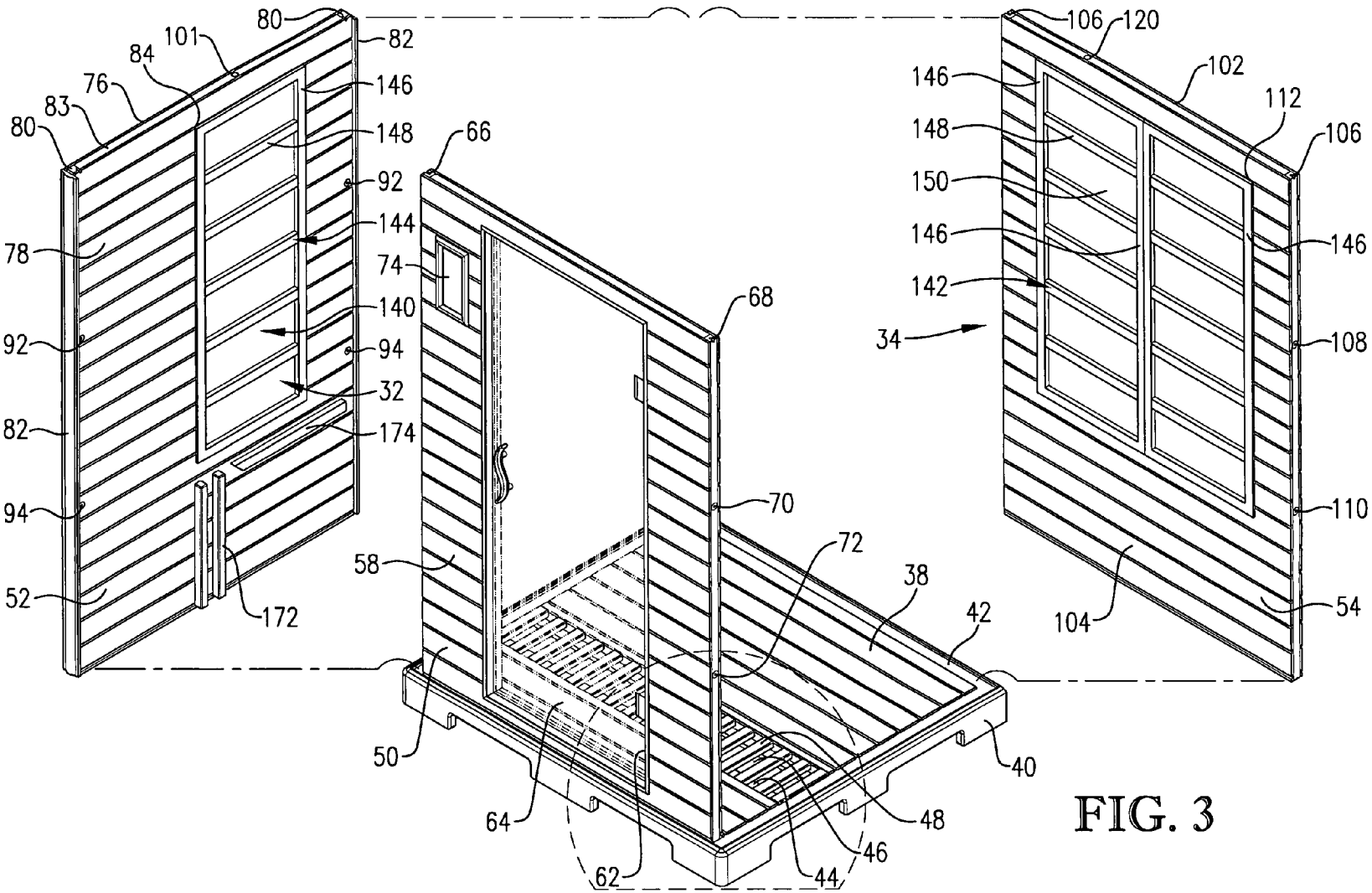
FIG. 3 is an exploded perspective view illustrating initial steps in the construction of the sauna shown with the front panel positioned in the base panel and with the left hand and rear panels ready for installation.
Figure 4:
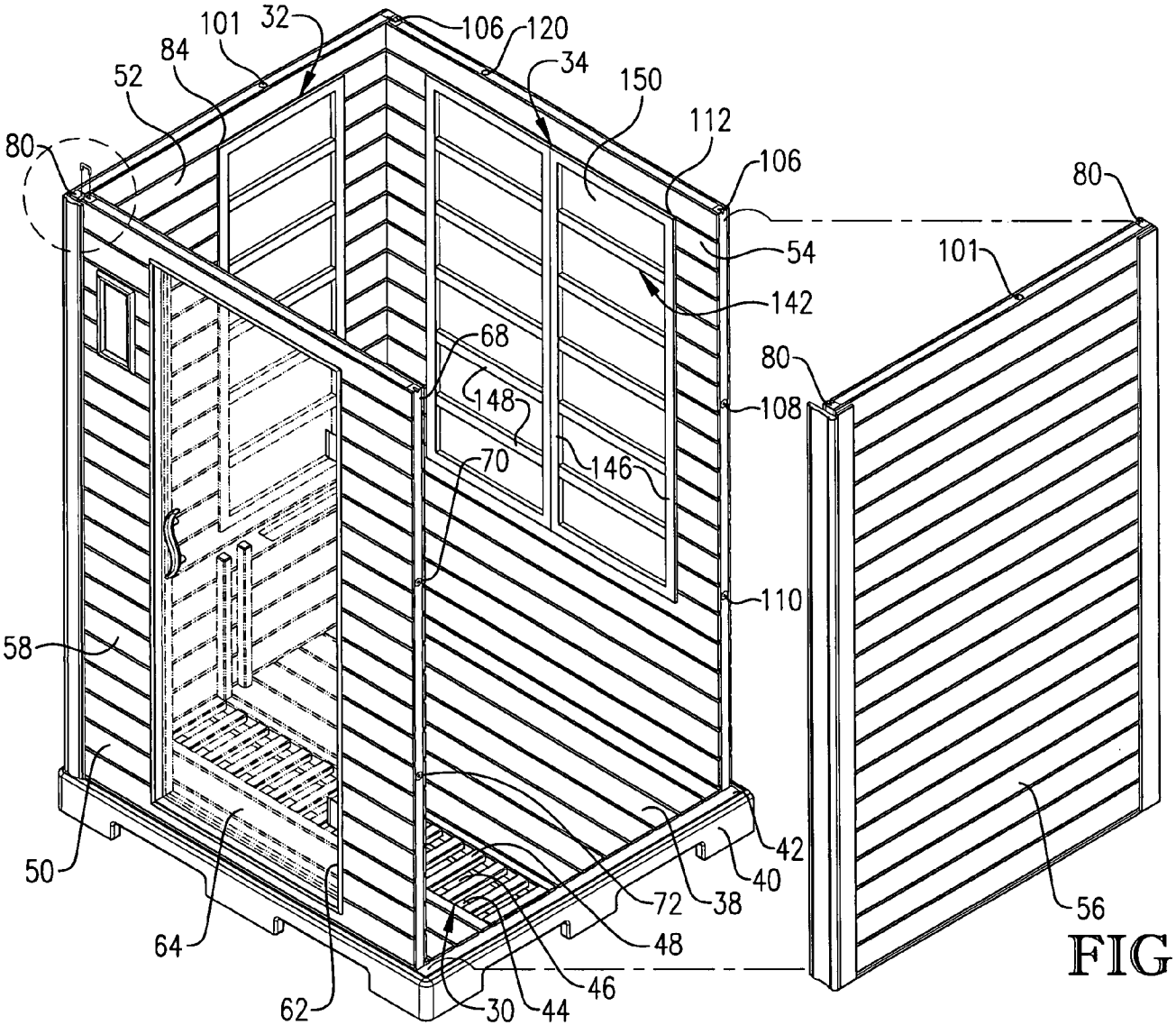
FIG. 4 is an exploded perspective view similar to that of FIG. 3, but showing installation of the right hand panel of the sauna.

The drawing figures do not limit the present invention to the specific embodiments disclosed and described herein. The drawings are not necessarily to scale, emphasis instead being placed upon clearly illustrating the principles of the invention.

DETAILED DESCRIPTION OF THE PREFERRED EMBODIMENT

Figure 5:
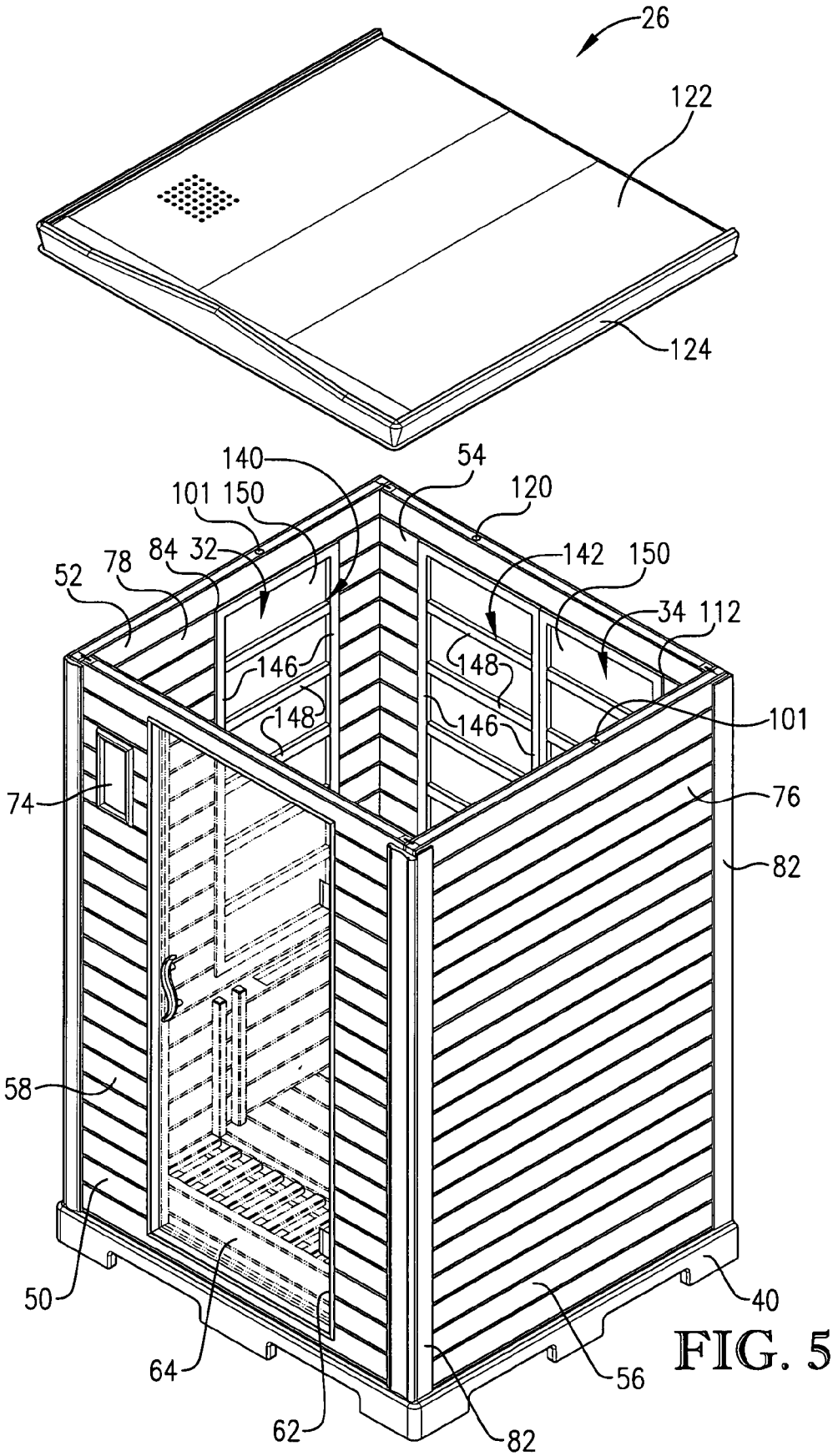
FIG. 5 is a perspective view similar to that of FIG. 4, and depicting installation of the top panel of the sauna.
Figure 6:
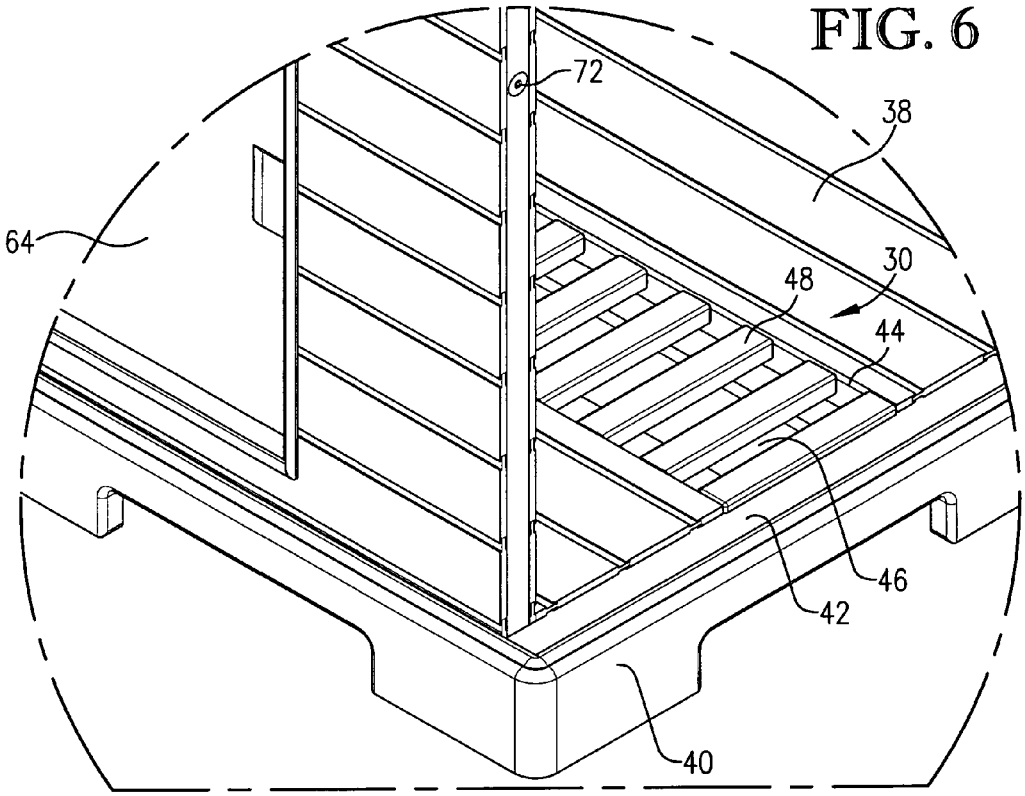
FIG. 6 is an enlarged fragmentary view from FIG. 3, and depicting the installation of the front panel into the base panel of the sauna.

Turning now to the drawings, a sauna 20 is illustrated in FIG. 1 and generally includes a base panel 22, upright side panels 24 extending upwardly from base panel 22, a top panel 26 surmounting the side panels 24 so as to define a sauna enclosure 28 (e.g., see FIG. 5). Additionally, the sauna 20 is equipped with a floor-mounted heater 30 as well as three upright heaters 32,34,36 which are operable to heat the enclosure 28. Although the illustrated sauna has a generally rectangular configuration, it is entirely within the ambit of the present invention to provide other sauna configurations (e.g., saunas having more or less upright panels to present different polygonal shapes or a circular shaped modular sauna with interconnected panels). The principles of the present invention are equally applicable to saunas using more or less heaters than those shown.

It is noted that the heaters 32,34,36 (and others as identified below) are preferably configured to emit far infrared radiation ("FIR") within the sauna 20 so as to provide both heating and desirable radiation treatment. More preferably, the heaters include carbon—black—containing planar heating elements. Those ordinarily skilled in the art will appreciate that such arrangement provides a dry sauna with FIR treatment. However, it is initially noted that certain aspects of the present invention are not limited to such a sauna (e.g., certain principles apply to other types of saunas, such as steam saunas) or heaters (e.g., traditional coil heaters, etc.).

Returning to the illustrated embodiment, the base panel 22 is preferably fabricated from wood (e.g., cedar) and has a slatted floor 38 as well as an outermost decorative footed perimeter 40 (e.g., formed of synthetic resin material). The base 22 is designed to present a continuous peripheral groove 42 between floor 38 and perimeter 40. Also, the base 22 has a laterally extending recess 44 which houses a drop-in FIR heater 46. A wooden grating 48 is located within the recess 44 and covers the heater 46.

The upright panels 24 in this embodiment include a front panel 50, left hand panel 52, rear panel 54, and right hand panel 56. The resulting enclosure 28 is substantially square in plan. As previously noted, however, other upright wall assemblies could employed, giving a variety of different enclosure footprints and shapes.

Front panel 50 preferably is fabricated largely from wood and includes a lapped fascia wall 58 and a similarly slatted interior wall 60. A central doorway 62 is provided in the front panel and a hingedly mounted door 64 (preferably glass) is mounted within the doorway. The butt ends of the front panel 50 are defined by vertical, solid wood risers 66,68, each of the latter carrying a pair of vertically spaced apart magnetic coupler bodies 70,72. Finally, external sauna control panel 74 is housed within front panel 50 to allow the user to control the operation of sauna 20.

Figure 9:
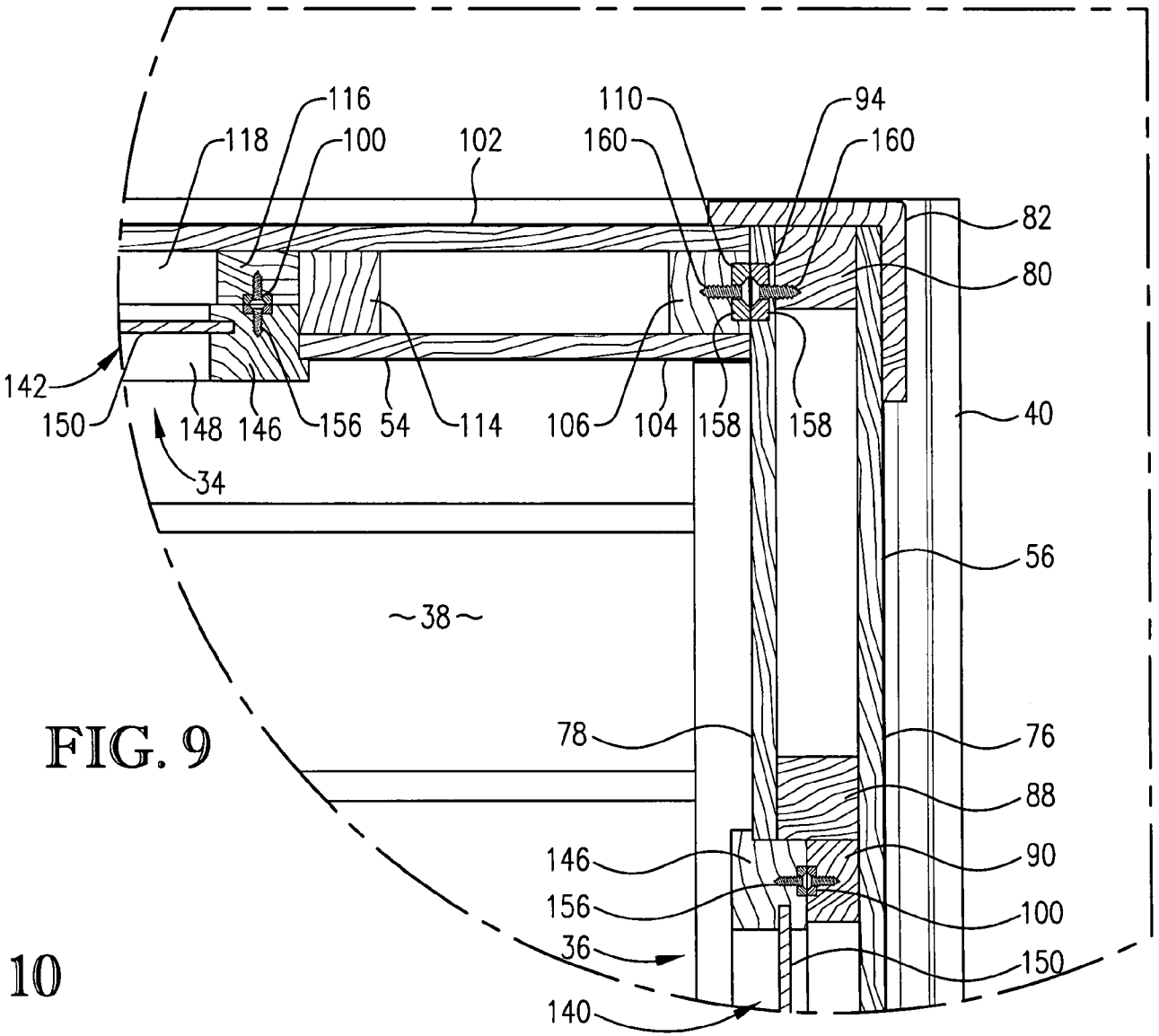
FIG. 9 is an enlarged fragmentary view from FIG. 8, and illustrating the magnetic coupling of the upright sauna panels and the magnetic coupling of the infrared heater panels to the inner faces of the upright sauna panels.
Figure 11:
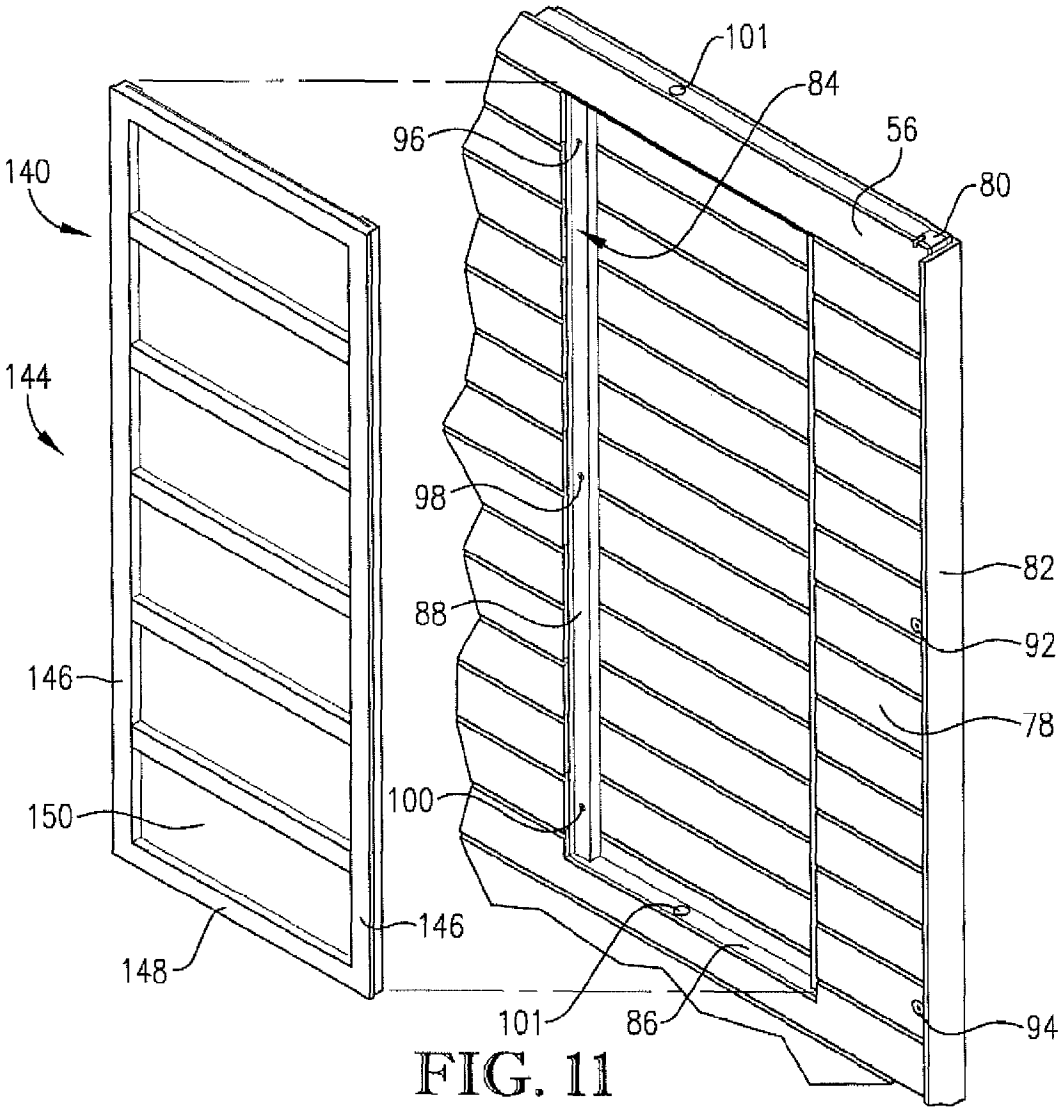
FIG. 11 is a fragmentary exploded perspective view of a side panel of the sauna, and showing the attachment of an infrared heater panel to the side panel.

The left and right hand panels 52,56 are essentially mirror images of each other and each preferably is fabricated from wood to present lapped exterior wall 76 and a similar lapped interior wall 78. The ends of the panels 52,56 are defined by vertical risers 80 and outboard L-shaped vertical trim pieces 82, and an uppermost horizontal top board 83 extends between the risers. As best seen in FIG. 11, each of the panels 52,56 has a vertical, essentially rectangular recess 84 formed therein. The recess 84 is bounded by baseboard 86, internal risers 88,90 (see FIG. 9) and a top board (not shown).

Each of the panels 52,56 has a pair of vertically spaced apart magnetic coupler bodies 92,94 located just inboard of each of the trim pieces 82. Additionally, the internal risers 90 each have a total of three embedded vertically spaced apart magnetic coupler bodies 96,98,100. Finally, each panel 52,56 has electrical power cableway openings 101 in the top and bottom thereof which are important for purposes to be made clear.

Rear panel 54 preferably is formed of wood and has a lapped exterior wall 102, a lapped interior wall 104 and endmost vertical risers 106. The risers 106 each have a pair of vertically spaced apart magnetic coupler bodies 108,110 embedded therein. The rear panel 54 also has a vertical, substantially rectangular recess 112 defined by internal risers 114,116 as well as baseboard 118 and a top board (not shown). The risers 116 have magnetic coupler bodies 96,98, 100 embedded therein, in exactly the same fashion as the previously described risers 90 forming a part of the left and right hand panel recesses 84. Upper and lower electrical cableway openings 120 are also provided.

Figure 7:
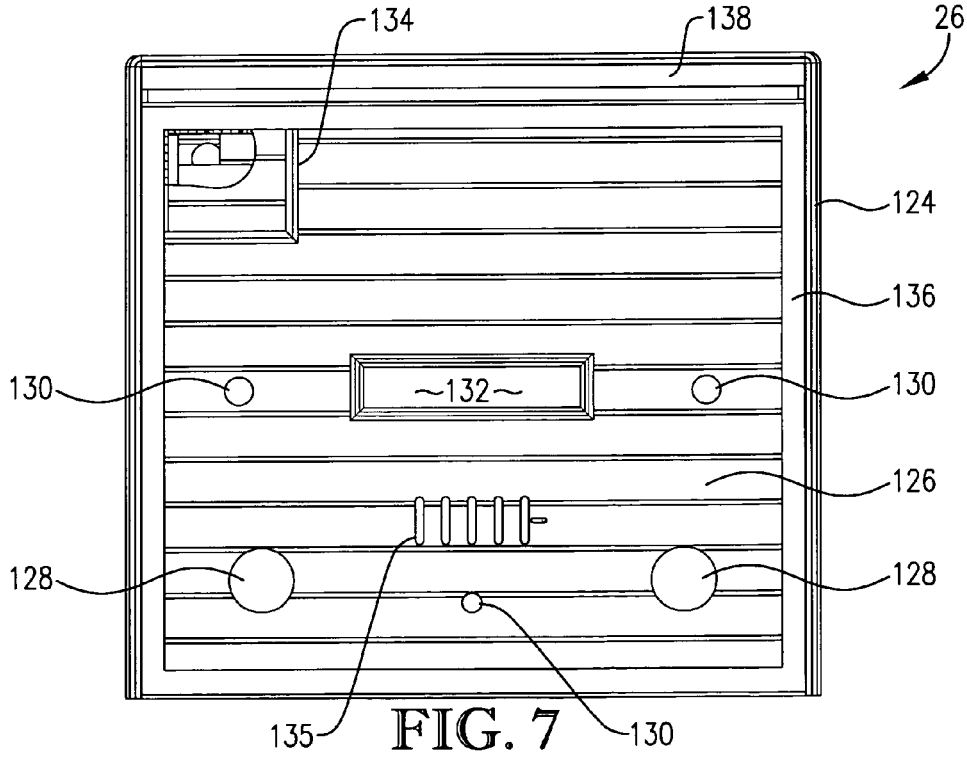
FIG. 7 is a view of the underside of the top panel of the sauna.
Figure 8:
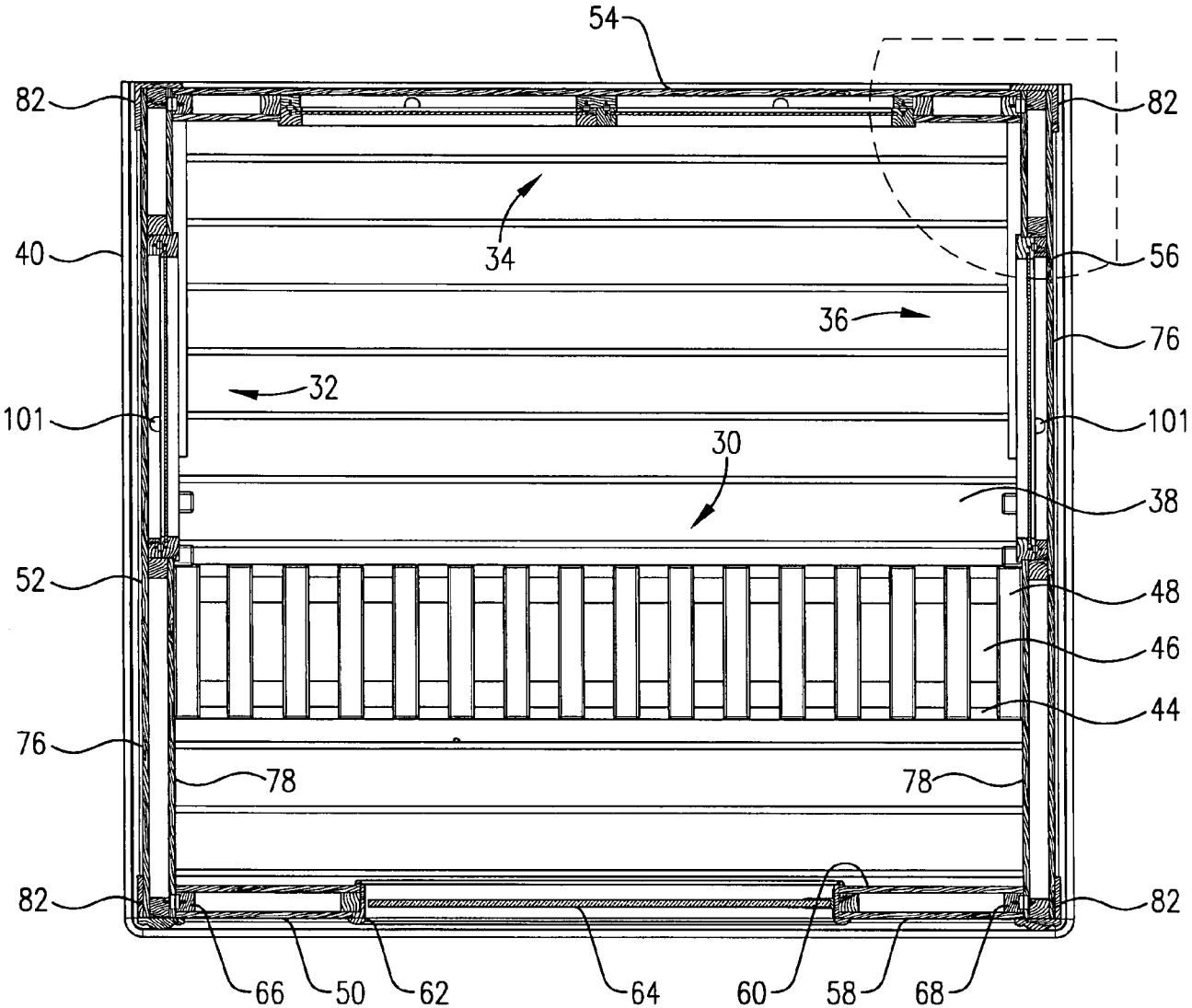
FIG. 8 is a horizontal sectional view of the completed sauna.

Top panel 26 includes an uppermost roof 122 and a peripheral skirt 124. Referring to FIG.7, it will be seen that the preferred top panel 26 presents a lapped interior wall 126 with a number of optional accessories mounted thereon, e.g., speakers 128, accent lights 130, main light 132, housing 134 designed to accommodate stereo equipment such as a CD player and amplifier, and an adjustable vent assembly 135. Further, the interior of top panel 26 presents a peripheral groove 136 between skirt 124 and wall 126, as well as a forward overhang 138. As with the other panels, the top panel 26 is preferably formed primarily of wood (e.g., cedar).

As noted, the panels 52,54,56 each support a respective heater 32, 34,36 within the corresponding recesses 84 and 112, namely side panel FIR heaters 140 and rear panel FIR heater 142. These FIR heaters are identical except for the size difference, and each includes an appropriately dimensioned frame 144 made up of vertical members 146 and spaced apart crosspieces 148. The frames 144 are preferably formed of wood (e.g., cedar). Moreover, each frame 144 supports a thin, planar, sheet-like FIR heating element 150, as previously explained. It will also be seen that the endmost vertical members 146 have three vertically spaced apart magnetic coupler bodies 152,154,156.

Figure 10:
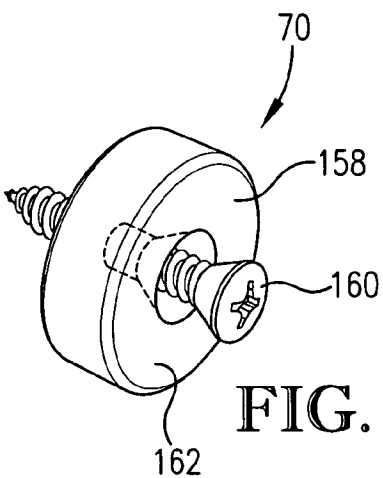
FIG. 10 is an enlarged perspective view illustrating one of the magnetic coupler bodies used in constructing the sauna.
Figure 12:
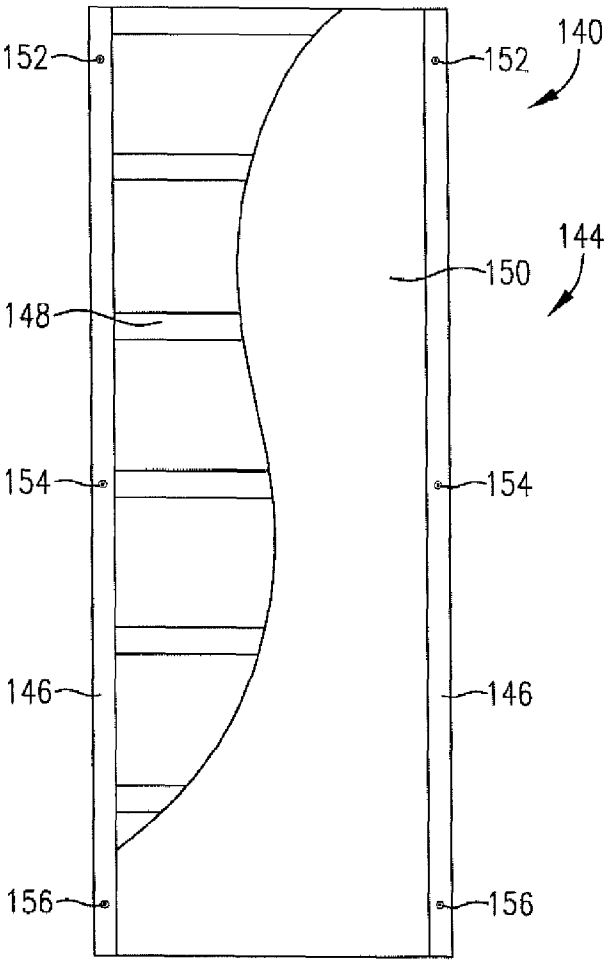
FIG. 12 is a rear view of one of the infrared heater panels.

All of the magnetic coupler bodies described above, namely bodies 70,72,92-100,108,110 and 152-156, are preferably of the same physical construction, except for size difference. FIG. 10 depicts an exemplary coupler body 70 in the form of an annular segment 158, with a fastening screw 160 extending through the central opening thereof. It will be seen that the segment 158 presents a substantially planar outer surface 162. The segments 158 may all be formed of magnetic material, with adjacent segments being of opposite polarity. Alternately, some of the segments may be formed of magnetic material, while mating segments may be fabricated from steel or other magnetically susceptible material. In any case, it is important that adjacent segments 158 used for connection purposes be magnetically complemental, i.e., so as to generate the requisite magnetic coupling attraction and force between the adjacent segments. One suitable magnetic material is available under the model designation NF38 from Wuxi Rare-Earth Permanent Magnet Plant of Dong Bei Tang Zhen, Wuxi, JiangSu, China. This company is accessible via Internet at the following two address www.magnet888.com or www.chinaecom. com/CompanySite/6006/eng/index.asp-?SiteID=6006. More specifically, the preferred magnetic material has the following properties:

| | Br | | HcB | | Hcj | | BH max | | Max. temperature |
|---|---|---|---|---|---|---|---|---|---|
| Model | T | kgs | KA/m | koe | KA/m | Koe | KJ/M$^3$ | MGOe | ° C. |
| N38 | 1.21-1.25 | 12.1-12.5 | ≧899 | ≧11.3 | ≧955 | ≧12 | 287-310 | 38-39 | 80 |

The construction of sauna 20 is a simple and straightforward proposition, which is greatly facilitated through use of the previously described magnetic coupler bodies. Moreover, use of this type of interconnection substantially eliminates unsightly fasteners, brackets and other connection hardware which can detract from the aesthetic appearance of the finished sauna.

Specifically, in the first step, the base panel 22 is appropriately positioned, and the front panel 50 is inserted into the forward lateral run of groove 42. While the front panel is held in place, the left hand panel 52 is positioned within the left hand run of groove 42 in such fashion that the forward trim piece 82 covers the joint between the front and left hand panels 50,52 (see FIG. 13). In addition, by virtue of the magnetically complemental nature and mating location of the coupler bodies 70,72 and 92,94, a strong magnetic connection is established between these panels. In order to achieve the most secure connection, the coupler bodies come into direct face-to-face contact with each other.

The rear panel 54 is next inserted into the rear run of the groove 42, again in a manner such that the rearmost trim piece 82 of panel 52 covers the joint. Furthermore, the magnetic coupler bodies 108,110 of rear panel 54 mate in direct face-to-face contact with the rear set of magnetic coupler bodies 92,94 carried by the panel 52.

The right hand panel 56 is then installed in the same fashion, so that the trim pieces 82 cover the joints between right hand panel and front and rear panels 50,54. The fore-and-aft sets of magnetic coupler bodies 92,94 carried by the right hand panel 56 magnetically couple with the couplers 70,72 and 108,110 of the front and rear panels (see FIG. 9).

Appropriate electrical wiring is fed through base panel 22 and the panel cableways 101,120 for purposes of providing electrical power to the heaters 30 and 32, as well as to the control panel 74 and accessories 128-134. At this point, the individual FIR heaters 140 and 142 are installed. This involves making a suitable electrical connection with the heaters and pressing them into the corresponding recesses 84 and 112. During this installation, the magnetic coupler bodies 96-100 of the panel risers come into direct face-to-face contact with the coupler bodies 152-156 carried by the panel frames 144. As such, the heaters are magnetically coupled to the associated panels, again with the complete avoidance of threaded fasteners or other types of conventional connection hardware.

The final installation step involves placement of top panel 26. This is accomplished by simply pressing panel 26 downwardly over the upright panels 24, i.e., with the upper ends of the panels 50-56 being inserted into groove 136. No further connection of the panel 26 is required. Of course, the accessories 128-134 are connected to the sauna wiring.

Figure 13:
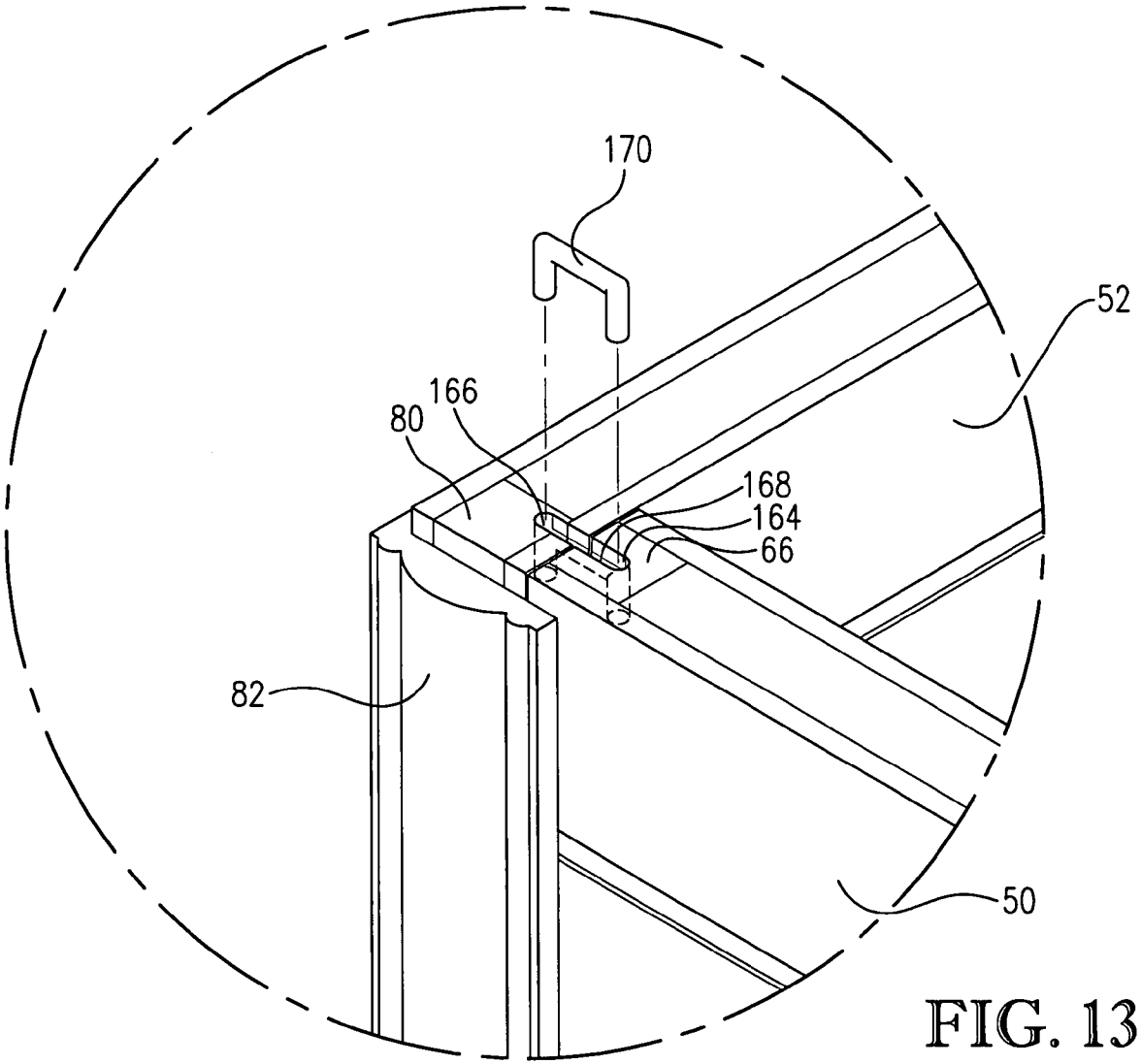
FIG. 13 is an enlarged fragmentary view from FIG. 4 and depicting the installation of a clip fastener between the front panel and left hand panel of the sauna.

The saunas of the invention can be modified in a number of ways. For example, in some instances it is desirable to install mechanical connection structure between the upright panels 50-56, but without creating undesirable visible evidence of such connection structure. As illustrated in FIG. 13, the connection ends of the panels can be provided with mating recesses 164,166 which cooperatively form a U-shaped slot 168 which bridges an internal wall of one of the panels. A complemental U-shaped connection clip 170 is inserted into the slot 168 to provide an additional connection. However, this clip 170 is entirely recessed and covered upon installation of top panel 26.

The saunas may also be provided with a conventional bench or other types of seating. To this end, the panels 52,56 may be equipped with vertical and horizontal wooden mounts 172,174, allowing a vertical kickplate and horizontal bench (not shown) to be installed. Of course, other seating assemblies may be used.

While the invention is particularly concerned with saunas, the principles thereof are not so limited. That is to say, use of magnetic connection hardware to effect coupling of the wall components can be adapted for other types of personal care enclosures, for example, wet saunas and dressing facilities such as cabanas.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventors hereby state their intent to rely on the Doctrine of Equivalents to determine and assess the reasonably fair scope of the present invention as pertains to any apparatus not materially departing from but outside the literal scope of the invention as set forth in the following claims.

Having thus described the preferred embodiments of the invention, what is claimed as new and desired to be protected by Letters Patent includes the following:

What is claimed is:

1. A sauna comprising:

a base panel;

a plurality of upright panels extending upwardly from said base panel;

a top panel surmounting said upright panels, said panels cooperatively defining a sauna enclosure with an interior sauna chamber;

at least one sauna heater operable to heat the sauna enclosure; and connection structure between adjacent ones of said upright panels and including complemental magnetic coupler bodies operable to magnetically interconnect the adjacent panels, said connection structure comprising magnetic coupler bodies carried by each of said upright panels, said magnetic coupler bodies being concealed by the respective adjacent upright panels so as not to be visible from the sauna chamber, said connection structure further including a mechanical connector spanning the joints between adjacent ones of the upright panels, said mechanical connector being concealed by the respective adjacent upright panels so as not to be visible from the sauna chamber.

2. The sauna as claimed in claim 1, said base panel having a peripheral groove, each of said upright panels presenting a lower end received within said base panel groove.

3. The sauna as claimed in claim 1, said upright panels including a front panel equipped with a door, a pair of side panels, and a rear panel.

4. The sauna as claimed in claim 1, said magnetic coupler bodies being located adjacent the side margins of each of said upright panels, with proximal magnetic coupler bodies being magnetically complemental.

5. The sauna as claimed in claim 1, said at least one sauna heater comprising a far infrared heater.

6. The sauna as claimed in claim 1; and mounting structure for securing said at least one sauna heater to a corresponding panel, said mounting structure including a magnetic coupling structure operable to magnetically couple said at least one sauna heater to the corresponding panel.

7. The sauna as claimed in claim 6, said magnetic coupling structure being concealed by said at least one sauna heater and said corresponding panel so as not to be visible from the sauna chamber.

8. The sauna as claimed in claim 7, said magnetic coupling structure comprising magnetically complemental coupler bodies carried by said at least one sauna heater and the corresponding panel, said coupler bodies being oriented to be proximal when said at least one sauna heater is mounted to the corresponding panel.

9. The sauna as claimed in claim 8, said magnetic coupler bodies being oriented for direct, face to face contact when said at least one sauna heater is mounted to the corresponding panel.

10. The sauna as claimed in claim 7;

a plurality of said sauna heaters, each being operable to be respectively mounted to one of said upright panels; and mounting structure for each of said sauna heaters comprising magnetic coupling structure for magnetically mounting the heater to the respective one of the upright panels.

11. The sauna as claimed in claim 7, said corresponding panel including only one of the upright panels.

12. The sauna as claimed in claim 1, said certain panels presenting adjacent overlapping margins, said magnetic Coupler bodies being located along each of the adjacent margins, with proximal magnetic coupler bodies being magnetically complemental.

13. The sauna as claimed in claim 12, said magnetic coupler bodies being concealed by said adjacent margins so as not to be visible from the sauna chamber.

14. The sauna as claimed in claim 1, said upright panels each presenting a top margin with a recess defined therein, said mechanical connector extending into the recesses defined in the top margins of the respective adjacent upright panels.

15. The sauna as claimed in claim 14, said recesses in adjacent upright panels cooperatively forming a U-shaped slot, said mechanical connector comprising a complemental U-shaped clip operable to be received within said slot.

* * * * *